United States Patent [19]

Hays

[11] 3,965,719

[45] June 29, 1976

[54] CUTTING ATTACHMENT FOR CRIMPING TOOL

[75] Inventor: Kenneth Scott Hays, Exton, Pa.

[73] Assignee: AMP Incorporated, Harrisburg, Pa.

[22] Filed: Nov. 11, 1974

[21] Appl. No.: 522,550

[52] U.S. Cl. ..... 72/410; 72/409; 81/421; 7/5.6

[51] Int. Cl.[2] ..... B21D 37/12

[58] Field of Search ..... 72/409, 410, 326; 29/203 H, 203 HM; 81/421; 140/123.6; 7/5.4, 5.6, 6, 14.1 R; 228/318

[56] References Cited

UNITED STATES PATENTS

| | | | |
|---|---|---|---|
| 719,782 | 2/1903 | Furbish | 7/5.6 |
| 1,102,384 | 7/1914 | Bernard | 72/409 |
| 2,975,425 | 3/1961 | Diehm et al. | 72/410 |
| 3,172,133 | 3/1965 | Rizzo | 81/421 |
| 3,312,988 | 4/1967 | Shannon | 72/410 |
| 3,345,856 | 10/1967 | Werner et al. | 72/410 |
| 3,553,999 | 1/1971 | Rommel | 29/203 H |

*Primary Examiner*—Lowell A. Larson
*Attorney, Agent, or Firm*—Allan B. Osborne

[57] ABSTRACT

An attachment to be mounted on a crimping tool. The attachment includes two cutter members. Each cutter member includes a blade with a cutting edge. The cutter members are coupled to the jaws of the crimping tool with the cutting edges facing each other so that when the handles of the cutting tool are moved, the cutting edges move toward each other.

6 Claims, 6 Drawing Figures

CUTTING ATTACHMENT FOR CRIMPING TOOL

This invention relates to cutters and more particularly to a cutting attachment for a crimping tool.

Hand operated crimping tools are well known in the art. They are used in joining connectors to electrically conductive wires. The juncture between the connector and the wire is made by placing the conductor in the connector and then crimping the connector so that it closely grips the conductor to assure electrical contact therebetween. Typical of crimping tools presently known and used are those described in Werner U.S. Pat. Nos. 2,900,854, 3,345,856, 3,410,129 and Des. 201,915.

Often, the wire must be cut to a predetermined length before it is crimped. This can present substantial inconvenience and difficulty when the task must be accomplished in the field or where the wire includes a conductor of substantial thickness since the personnel charged with crimping the connector to the conductor may not have on hand or readily available a suitable cutting tool. In such circumstances, a special cutter must be obtained, or the conductor must be cut with a hacksaw blade.

The present invention avoids the disadvantages described above by providing cutting members which may be attached to a crimping tool. The cutting members have facing cutting edges which may be employed to cut wire. The cutting members may be attached to crimping tools already in the field or they may be connected to the crimping tools as they are manufactured. The cutting members rely upon the same leverage generated by the crimping tool when it is used to crimp a connector so that a wire having a conductor of substantial thickness can be cut easily.

Generally speaking, the invention, in one aspect, relates to a cutting attachment for a crimping tool comprising first and second cutter members. The first cutter member is comprised of an elongated member and includes a sliding surface, a first cutting edge and means for pivotally coupling the first cutter member to a support on the crimping tool. The cutting edge is remote from the coupling means and is in generally facing relation thereto.

The second cutter member includes a sliding surface and a second cutting edge. Means are provided for coupling the second cutter member to another support on the crimping tool. The second cutting edge faces generally away from the last named coupling means, and the sliding surfaces on the first and second cutter members are in sliding engagement with each other when the cutter members coupled to their respective supports so that the cutting edges cooperate to cut an item disposed therebetween.

In another aspect, the invention relates to a crimping tool of the type comprising handles which are pivotally connected together at a pivot, each of the handles being connected to a pair of spaced jaw plates. The jaw plates are pivotally connected to each other at a distance from their pivotal connection to the handles and each of the pairs of jaw plates comprises means for supporting a crimping jaw. The tool further includes a first cutter member coupled to one pair of jaw plates and a second cutter member coupled to the other pair of jaw plates. Each of the cutter members extends in the same lateral direction from the jaw plates and they are disposed in generally side by side relation. Each of the cutter members includes a cutting edge and the cutting edges are in generally facing relation to each other so that when the pairs of jaw plates are moved relative to each other the cutting edges move toward each other to cut an item disposed therebetween.

For the purpose of illustrating the invention, there are shown in the drawings forms which are presently preferred: it being understood, however, that this invention is not limited to the precise arrangements and instrumentality shown.

Figure 1:
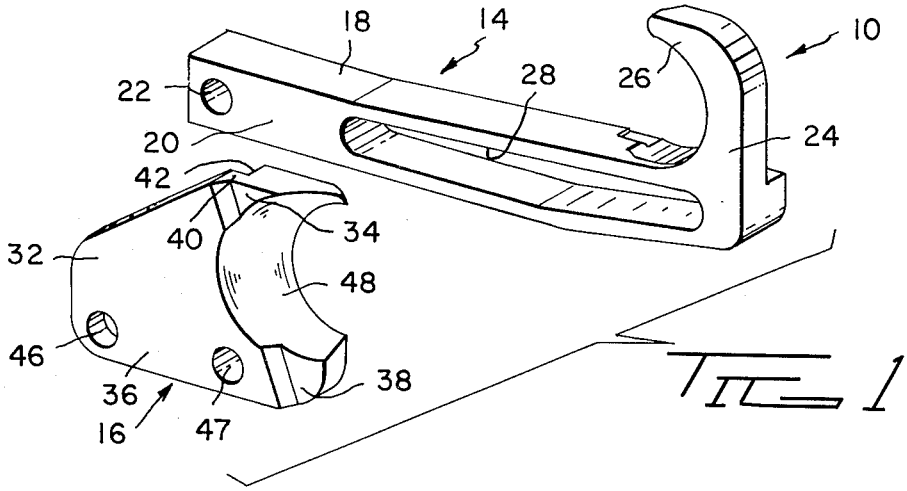
FIG. 1 is a perspective view of one form of the cutter members comprising the attachment.

Now referring to the drawing for detailed description of the invention, a cutting attachment 10 for a crimping tool is illustrated in FIG. 1. It comprises a first cutter member 14 and a second cutter member 16. The first cutter member comprises an elongated member 18 which comprises side walls 20 (only one of which is shown). An aperture 22 in side walls 20 is disposed at one end of elongated member 18. At the other end of elongated member 18 side walls 20 extend upwardly in a generally hooked shaped configuration to define a generally concave cutting edge 26. An elongated slot 28 is formed in side walls 20 intermediate aperture 22 and blade 24.

The second cutter member 16 includes first and second portions 32 and 34. Portion 32 is comprised of side walls 36 (one of which is not shown) while portion 34 is comprised of side walls 38 (one of which is not shown).

Portions 32 and 34 are both relatively flat. Portion 34 is laterally offset from portion 32 and is interconnected thereto by a skirt 40 which defines a ledge 42.

Aperture 46 is formed in side walls 36 at one end of second cutter member 16. Aperture 47 is formed in side walls 36 at an intermediate location on second cutter member 16 and in spaced relation from aperture 46. A concave cutting edge 48 is formed in the end of second portion 38. The cutting edge faces generally away from aperture 46.

The first and second cutter members are proportioned so that cutting edges 26 and 48 cooperate to cut an item disposed therebetween as the aperture 46 moves along slot 28.

Figure 3:
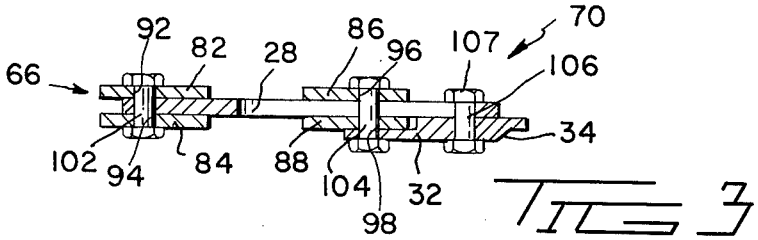
FIG. 3 is a sectional view taken along line 3—3 of FIG. 2.
Figure 2:
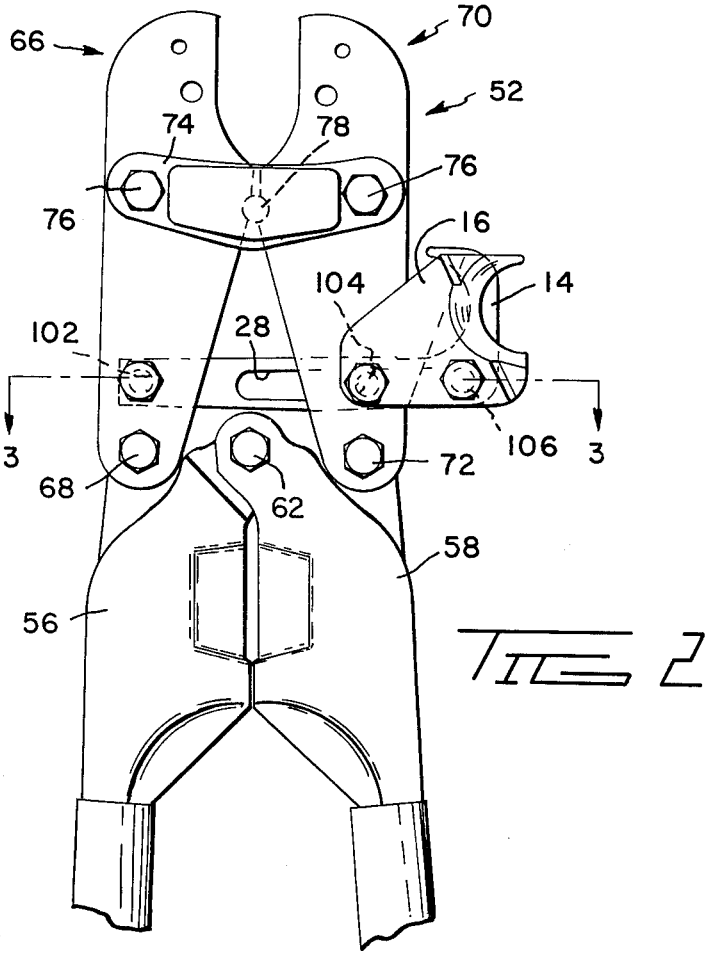
FIG. 2 is a side elevation view of a crimping tool with the cutter attachment coupled thereto.
Figure 5:
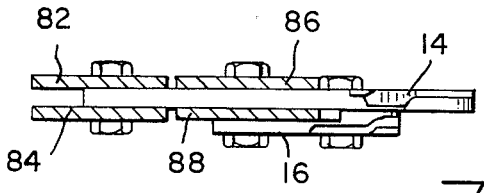
FIG. 5 is a sectional view taken along line 5—5 of FIG. 4.

The cutting attachment can be connected to a crimping tool as best shown in FIGS. 2 and 3.

The crimping tool comprises two handle portions 56 and 58 which are pivotally connected to each other by a pin 62. As seen in FIGS. 2 and 3, a pair of jaw plates 66 are pivotally connected to handle portion 56 by a pivot pin 68. A second pair of jaw plate 70 are pivotally connected to handle portion 58 by a pivot pin 72. The pairs of jaw plates 66 and 70 are interconnected by two straps 74 (only one of which is shown). The straps are pinned to the jaw plates in each pair 66 and 70 at their ends by suitable pivot pins 76. A bearing pin 78 is disposed between the pairs of jaw plates 68 and 70 to enable them to rotate with respect to each other in a manner which will be more completely described herein.

As best seen in FIG. 3 pair 66 comprises jaw plates 82 and 84 while pair 70 comprises jaw plates 86 and 88. The jaw plates in each pair are disposed on opposite sides of the handle portions 56 and 58 and are provided with suitable spacers so that the distance between them can be maintained. Further, the upper facing portions of the jaw plates in each of the pairs are spaced from each other so that sufficient space is provided for accomodating crimping dies. The manner in which the dies are coupled to the jaw plates and the configuration that the dies may take form no part of this invention. They are described in substantial detail in the patents mentioned above. Hence, they will not be described herein.

Apertures 92 and 94 are provided in jaw plates 82 and 84 while apertures 96 and 98 are provided in jaw plates 86 and 88. The apertures are located between pins 68 and 76 in pair 66 and between pins 72 and 76 in pair 70. The apertures comprise means for coupling the cutting attachment to the crimping tool in a manner which will be described more completely herein.

The cutting attachment 10 may be coupled to the crimping tool 52 in the following manner. The first cutter member 14 is slipped between jaw plates 82 and 84 and jaw plates 86 and 88 until aperture 22 is aligned with apertures 92 and 94 and the blade 24 is extending laterally of jaw plates 86 and 88. Preferably, the first cutter member 14 is turned so that blade 24 faces in the same general direction as the opening between the pairs of jaw plates. The first cutter member 14 is connected to jaw plates 82 and 84 by a pin 102 which extends through apertures 92 and 94 in the jaw plates and through aperture 22 in the first cutter member.

A second pin 104 is placed through apertures 96 and 98 in jaw plates 86 and 88 and through slot 28. Pin 104 is somewhat longer than pin 102 so that it can be received in aperture 46 in the second cutter member 16. Thus, as best seen in FIG. 3 the second cutter member is supported on the outside of an adjacent to jaw plate 88. It is retained on the jaw plate by pin 104.

Since the portions 32 and 34 of the second cutter member are offset from each other, the wall opposite side wall 38 is in sliding engagement with side wall 20 on cutter member 14. Further since ledge 42 is spaced from the edge of jaw plate 88, the second cutter member is able to move relative to that jaw plate as the handle portions are moved.

A third pin 106 is connected to cutter member 16 at aperture 47 and extends through slot 28. The pin may be a threaded fastener that is held in place by a nut 107. As an alternative, the pin may be held in place by a split ring.

Pins 104 and 106 which are spaced from each other by being disposed on opposite sides of the pair of jaw plates 70 cooperate with the elongated slot 28 to guide the cutter members for movement along a straight line.

In the alternative, the cutting attachment may be preassembled by connecting the first and second cutter members to each other by pin 106 and nut 107. Then only pins 102 and 104 need be connected to the jaw plates to mount the fully assembled cutter attachment to the crimping tool.

Figure 4:
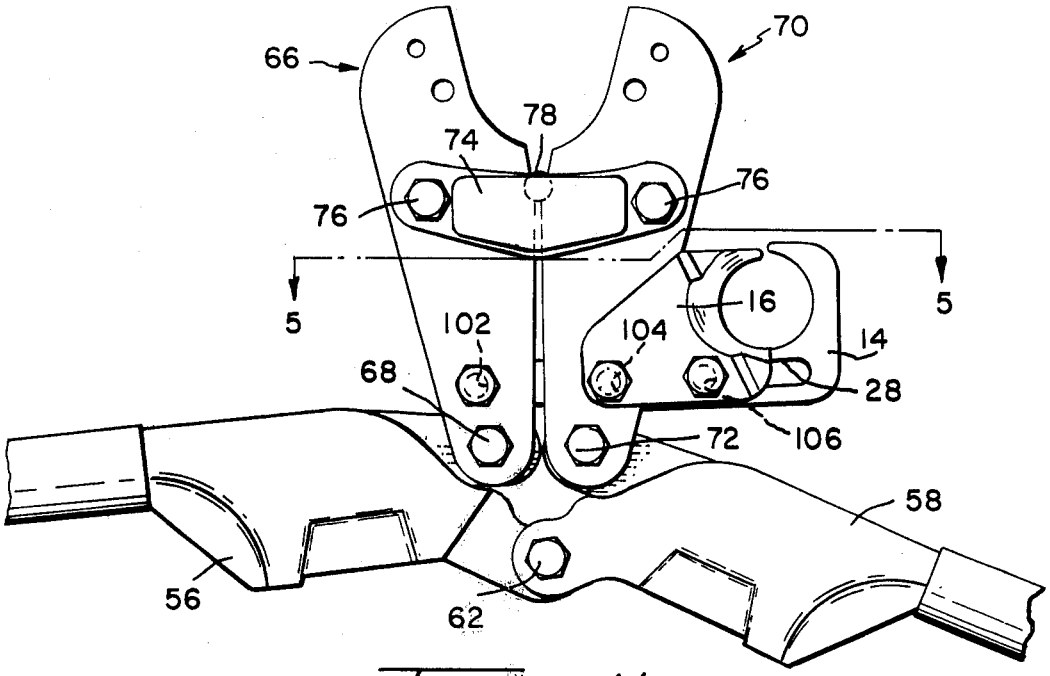
FIG. 4 is a side elevation view of the crimping tool illustrated in FIG. 2 with the jaws thereof in an open position.

The first and second cutter members extend in the same lateral direction and are arranged so that cutting edges 26 and 48 are in alignment with each other as illustrated in FIGS. 2 and 4 and so that their facing side walls are in mutual sliding engagement with each other.

In order to use the cutting attachment after it is mounted on the tool, handle portions 56 and 58 are spread apart as shown in FIG. 4. This causes the first cutter member 16 to move to the right (in FIG. 4) relative to the second cutter member thereby separating the cutting edges. The cutter members are maintained in alignment with each other by virtue of the fact that pins 104 and 106 slide through slot 28 while the second cutter member 16 is supported by pin 104 on the side wall of jaw plate 88. As the handles are brought together, the two cutter members are also brought together whereby the cutting edges 26 and 48 cooperate to cut an item disposed therebetween. Significantly, it should be noted that the pins 102 and 104 are located on the jaw plates at a location which results in a mechanical advantage being achieved as the handles 56 and 58 are brought together. While the mechanical advantage which is achieved is not as substantial as that which is accomplished at the crimping jaws, nevertheless, it is substantially greater than could be accomplished otherwise.

Figure 6:
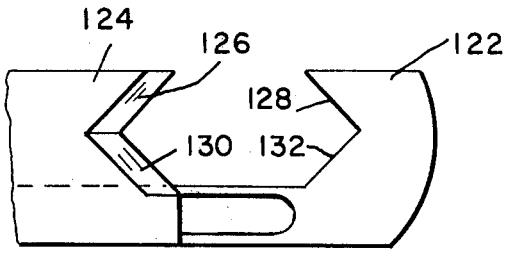
FIG. 6 is a side elevation view of a portion of another form of the attachment.

In FIG. 6 shows a portion of another form of cutting attachment 120 which is particularly suitable for cutting wire comprising a stranded conductor. This attachment includes first and second cutter members 122 and 124 which are substantially the same as cutter members 14 and 16. However, the cutting edges 126 and 128 which they support are generally V-shaped. Thus when stranded wire is cut, the strands are forced into the notch 130 and 132 at the base of each blade so that they are maintained in a tight group rather than being spread along the cutting edges. Thus, the stranded conductor can be slipped into a connector without bunching the strands after they are cut.

The cutting attachments disclosed herein are relatively simple. They can be made as a part of a crimping tool when it is manufactured, or they can be attached to the tool in the field after manufacture. Further, the blades can be readily disconnected, connected and removed from the tool by merely removing pins 102 and 104 from their respective locations. Still further, the invention results in both a cutter and crimper being on the same tool thereby eliminating the need of a workman to carry two tools.

While the invention has been described with regard to certain forms thereof, it is apparent that many other forms will be obvious to those skilled in the art, in view of the foregoing description. Thus, the scope of the invention should not be limited by that description, but, rather, only by the scope of the claims appended hereto.

I claim:

1. In a crimping tool of the type comprising handles pivotally connected together at a pivot, a pair of spaced jaw plates pivotally connected to each of said handles by a first pivot and pivotally connected to each other at a distance from their pivotal connection to said handles by a second pivot and wherein each of said pairs comprises means for supporting a crimping jaw, the improvement comprising a first cutter member coupled to one pair of said jaw plates and a second cutter member coupled to said other pair of jaw plates, each of said cutter members being connected to their respective jaw plates at a point between said first and second pivots, and extending in the same lateral direction from said jaw plates with said cutters being disposed in generally side by side relation, each of said cutter members including a cutting edge, said cutting edges being in generally facing relation to each other so that when said pairs of jaw plates are moved relative to each other about said second pivot said cutting edges move in said lateral direction toward each other to cut an item disposed therebetween.

2. A crimping tool as defined in claim 1 wherein said first cutter member extends between the jaw plates in each of said pairs, means for pivotally connecting said first cutter member to the pair of jaw plates remote from said first cutting edge so that said first cutter member moves relative to said second pair of jaw plates when said first and second pairs of jaw plates are moved relative to each other, means for coupling said second cutter member to said other pair of jaw plates, and cooperable guide means on said first and second cutter members, said guide means cooperating to guide said first cutter member for movement along a generally straight line relative to said second cutter member.

3. A crimping tool as defined in claim 2 wherein said guide means includes a slot in said first cutter member, a first pin disposed between the jaw plates in said other pair of jaw plates and extending through said slot, a second pin, said second pin being coupled to said second member and extending through said slot, and said first and second pins are disposed on opposite sides of said other pair of jaw plates.

4. A crimping tool as defined in claim 3 wherein said second cutter member comprises two portions which are interconnected by a ledge, one of said portions comprising said means for coupling said second cutter member to said other pair of jaw plates, said other portion including said cutting edge, both of said portions including side walls, said one portion being disposed with its side wall along one of the jaw plates in said pair of jaw plates, said ledge and the edge of said last named jaw plate being spaced from each other to permit said second cutter member to move relative to said last named jaw plate and said side wall when said other portion is disposed in sliding side-by-side relation to said first cutter member.

5. A cutting attachment as defined in claim 3 wherein said cutting edges on said first and second cutter members are concave.

6. A cutting attachment as defined in claim 3 wherein said cutting edges on said first and second cutter members are generally notch-shaped.

* * * * *